US007093313B2

(12) United States Patent
DeBraal et al.

(10) Patent No.: US 7,093,313 B2
(45) Date of Patent: Aug. 22, 2006

(54) HEADREST LINKAGE

(75) Inventors: Jack A. DeBraal, Plymouth, WI (US); Michael J. Marchant, Franklin, WI (US)

(73) Assignee: The Brewer Company, LLC, Menomonee Falls, WI (US)

( * ) Notice: Subject to any disclaimer, the term of this patent is extended or adjusted under 35 U.S.C. 154(b) by 261 days.

(21) Appl. No.: 10/674,274

(22) Filed: Sep. 29, 2003

(65) Prior Publication Data

US 2005/0067875 A1 Mar. 31, 2005

(51) Int. Cl.
*A47C 20/04* (2006.01)

(52) U.S. Cl. ..... 5/622; 5/640; 5/643; 5/657; 248/292.12; 297/408

(58) Field of Classification Search ..... 5/621–624, 5/637, 640, 643, 648, 657; 297/408–410; 248/292.12

See application file for complete search history.

(56) References Cited

U.S. PATENT DOCUMENTS 487,625 A 12/1892 Kales
488,649 A 12/1892 Daggett
542,060 A 7/1895 Lentz
1,039,708 A 10/1912 Denguer
1,650,327 A 11/1927 Conrad
1,684,889 A 9/1928 Russ
1,891,629 A 12/1932 Van Wagner
1,967,422 A 7/1934 Nadelson
2,120,732 A 6/1938 Comper et al.
2,267,973 A 12/1941 Demcak
2,272,819 A 2/1942 Poetsch et al.
2,306,031 A 12/1942 Anderson et al.
2,538,993 A 1/1951 Travis
2,565,784 A 8/1951 Sheean
2,605,151 A 7/1952 Shampaine
2,606,801 A 8/1952 Shampaine (Continued)

*Primary Examiner*—Michael Trettel
(74) *Attorney, Agent, or Firm*—Ryan Kromholz & Manion, S.C.

(57) ABSTRACT

A linkage mechanism for an adjustable arm assembly. The linkage assembly may be used to support an object, such as a headrest for use in connection with an examination table. The linkage mechanism provides structure to interlock or disengage two adjoining arm sections. The linkage mechanism controls relative movement of two adjoining arm sections without affecting the movement of non-adjoined sections or the headrest. The linkage mechanism further provides friction retention means so that the adjoining arms will retain their relative position to one another even if they are not in an interlocked position.

22 Claims, 6 Drawing Sheets

U.S. PATENT DOCUMENTS

| | | | | |
|---|---|---|---|---|
| D170,305 | S | | 9/1953 | Claus |
| 2,652,887 | A | | 9/1953 | Fitzgerald |
| 2,659,902 | A | | 11/1953 | Fitzgerald et al. |
| 2,679,445 | A | | 5/1954 | Roehm |
| 2,682,671 | A | | 7/1954 | Faure |
| 2,788,529 | A | | 4/1957 | Moritzacky et al. |
| 2,801,142 | A | | 7/1957 | Adams |
| 2,941,215 | A | | 6/1960 | Johnson |
| 3,016,275 | A | | 1/1962 | Grant |
| 3,041,121 | A | | 6/1962 | Comper |
| 3,100,129 | A | | 8/1963 | Adolphson |
| D202,963 | S | | 11/1965 | Dailey |
| 3,215,834 | A | | 11/1965 | Tayman |
| D204,222 | S | | 3/1966 | Dailey |
| 3,281,141 | A | | 10/1966 | Smiley et al. |
| D207,081 | S | | 2/1967 | Katzfey et al. |
| D207,483 | S | | 4/1967 | Dottinger |
| 3,334,951 | A | | 8/1967 | Douglas, Jr. et al. |
| 3,348,893 | A | | 10/1967 | Katzfey et al. |
| 3,355,163 | A | | 11/1967 | Leinassar |
| 3,409,287 | A | | 11/1968 | Chervenka |
| 3,411,766 | A | | 11/1968 | Lanigan |
| 3,413,663 | A | | 12/1968 | Swann |
| 3,452,977 | A | | 7/1969 | Ryman |
| 3,499,529 | A | | 3/1970 | Katzfey et al. |
| D217,646 | S | | 5/1970 | Sherer |
| 3,638,935 | A | | 2/1972 | Lelugas et al. |
| 3,658,317 | A | | 4/1972 | Bartlett et al. |
| 3,724,004 | A | | 4/1973 | Behrens |
| 3,754,749 | A | | 8/1973 | Lyon et al. |
| 3,814,414 | A | | 6/1974 | Chapa |
| 3,817,512 | A | | 6/1974 | Torrey |
| 3,851,870 | A | | 12/1974 | Cook |
| 3,868,103 | A | | 2/1975 | Pageot et al. |
| 3,905,591 | A | | 9/1975 | Schorr et al. |
| 3,944,205 | A | | 3/1976 | Mueller |
| 3,947,686 | A | | 3/1976 | Cooper et al. |
| 3,967,128 | A | | 6/1976 | Smulewicz |
| 3,997,792 | A | | 12/1976 | Conrad et al. |
| 4,003,704 | A | | 1/1977 | Zurolo et al. |
| 4,034,972 | A | | 7/1977 | Peterson |
| D245,287 | S | | 8/1977 | Damico et al. |
| 4,045,078 | A | | 8/1977 | Shine |
| 4,057,240 | A | | 11/1977 | Damico et al. |
| 4,076,230 | A | | 2/1978 | Pike |
| D250,043 | S | | 10/1978 | Shine |
| 4,148,472 | A | | 4/1979 | Rais et al. |
| 4,168,099 | A | | 9/1979 | Jacobs et al. |
| 4,180,002 | A | | 12/1979 | Huempfner |
| 4,183,596 | A | | 1/1980 | Greene et al. |
| 4,186,917 | A | | 2/1980 | Rais et al. |
| 4,221,371 | A | | 9/1980 | Kuphal |
| 4,284,268 | A | | 8/1981 | Gauthier |
| 4,287,422 | A | | 9/1981 | Kuphal et al. |
| D263,777 | S | | 4/1982 | Thompson |
| 4,322,899 | A | | 4/1982 | Clune |
| D265,241 | S | | 6/1982 | Patterson |
| D265,242 | S | | 6/1982 | Patterson |
| D266,023 | S | | 8/1982 | McLachlan |
| D266,765 | S | | 11/1982 | Clune |
| 4,383,351 | A | | 5/1983 | Fenwick |
| 4,407,687 | A | | 10/1983 | Mitchell |
| 4,464,780 | A | | 8/1984 | Ruiz |
| 4,501,414 | A | | 2/1985 | Mason et al. |
| 4,506,872 | A | | 3/1985 | Westerberg et al. |
| 4,508,387 | A | | 4/1985 | Gilbert et al. |
| D278,668 | S | | 5/1985 | Simpkins |
| 4,516,805 | A | | 5/1985 | Leeper et al. |
| 4,529,185 | A | | 7/1985 | Gutierres |
| 4,540,165 | A | | 9/1985 | Green et al. |
| 4,545,628 | A | | 10/1985 | Richey |
| 4,547,092 | A | | 10/1985 | Vetter et al. |
| 4,552,403 | A | | 11/1985 | Yindra |
| 4,557,471 | A | | 12/1985 | Pazzini |
| 4,558,857 | A | | 12/1985 | Heller |
| D282,398 | S | | 1/1986 | Yindra |
| 4,586,398 | A | | 5/1986 | Yindra |
| 4,586,762 | A | | 5/1986 | Kennedy et al. |
| 4,589,124 | A | | 5/1986 | Ruiz |
| 4,589,642 | A | | 5/1986 | Schnelle et al. |
| 4,592,526 | A | * | 6/1986 | Kobelt ..... 248/284.1 |
| 4,600,248 | A | | 7/1986 | Pflieger |
| 4,602,756 | A | | 7/1986 | Chatfield |
| 4,606,575 | A | | 8/1986 | Kodet |
| 4,608,812 | A | | 9/1986 | Wilson |
| D286,481 | S | | 11/1986 | Case et al. |
| 4,653,129 | A | | 3/1987 | Kuck et al. |
| 4,665,574 | A | | 5/1987 | Filips et al. |
| 4,667,354 | A | | 5/1987 | Carey, Jr. et al. |
| 4,667,605 | A | | 5/1987 | Bastian |
| 4,691,393 | A | | 9/1987 | Kuck |
| 4,700,916 | A | | 10/1987 | Bastian et al. |
| 4,716,840 | A | | 1/1988 | Tringali et al. |
| 4,717,102 | A | | 1/1988 | Pflieger |
| 4,732,089 | A | | 3/1988 | Mueller |
| 4,732,430 | A | | 3/1988 | Byrns |
| 4,750,305 | A | | 6/1988 | Bastian |
| 4,752,977 | A | | 6/1988 | Smith et al. |
| 4,761,000 | A | | 8/1988 | Fisher et al. |
| D297,597 | S | | 9/1988 | Simpkins et al. |
| 4,796,846 | A | | 1/1989 | Meier et al. |
| 4,805,365 | A | | 2/1989 | Bastian |
| D300,657 | S | | 4/1989 | Simpkins et al. |
| 4,819,569 | A | | 4/1989 | Bastian et al. |
| 4,821,350 | A | | 4/1989 | Feldt |
| D300,997 | S | | 5/1989 | Simpkins et al. |
| 4,826,117 | A | | 5/1989 | Bastian et al. |
| 4,826,221 | A | | 5/1989 | Harmon |
| D301,925 | S | | 6/1989 | Simpkins et al. |
| 4,846,431 | A | | 7/1989 | Pflieger |
| 4,852,941 | A | | 8/1989 | Jones |
| 4,858,260 | A | | 8/1989 | Failor et al. |
| 4,865,303 | A | | 9/1989 | Hall |
| 4,872,656 | A | | 10/1989 | Brendgord et al. |
| 4,872,657 | A | | 10/1989 | Lussi |
| 4,905,266 | A | | 2/1990 | Kuck et al. |
| 4,913,413 | A | | 4/1990 | Raab |
| 4,916,725 | A | | 4/1990 | Quinter et al. |
| 4,937,902 | A | | 7/1990 | Ceike Shapiro |
| 4,956,592 | A | | 9/1990 | Schulte et al. |
| 4,958,816 | A | | 9/1990 | Chaney et al. |
| 4,961,610 | A | | 10/1990 | Reeder et al. |
| 4,966,351 | A | | 10/1990 | Klepacki |
| 4,968,013 | A | | 11/1990 | Kuck |
| 4,973,034 | A | | 11/1990 | Michele |
| 4,989,848 | A | | 2/1991 | Monroe |
| 4,995,067 | A | | 2/1991 | Royster et al. |
| 4,996,731 | A | | 3/1991 | Kruyt |
| 5,005,667 | A | | 4/1991 | Anderson |
| 5,016,268 | A | | 5/1991 | Lotman |
| D319,158 | S | | 8/1991 | Jones et al. |
| 5,037,053 | A | | 8/1991 | Fox et al. |
| D321,097 | S | | 10/1991 | Jones et al. |
| 5,078,349 | A | | 1/1992 | Smith |
| 5,081,808 | A | | 1/1992 | Bastian et al. |
| 5,084,927 | A | | 2/1992 | Parkevich |
| D326,381 | S | | 5/1992 | Heiligenthal et al. |
| 5,157,787 | A | | 10/1992 | Donnellan et al. |
| D330,771 | S | | 11/1992 | Chaney et al. |
| D330,813 | S | | 11/1992 | Spitzer et al. |
| 5,166,968 | A | | 11/1992 | Morse |
| 5,177,823 | A | * | 1/1993 | Riach ..... 5/636 |
| 5,203,135 | A | | 4/1993 | Bastian |
| D335,409 | S | | 5/1993 | Kellems |

5,208,928 A 5/1993 Kuck et al.
5,223,229 A 6/1993 Brucker
5,231,719 A 8/1993 Schnelle
D341,737 S 11/1993 Shepherd
5,269,326 A 12/1993 Verrier
5,279,011 A 1/1994 Schnelle
D344,802 S 3/1994 Kuck et al.
D345,266 S 3/1994 Koguma
5,329,657 A 7/1994 Bartley et al.
5,339,750 A 8/1994 Smies
5,345,632 A 9/1994 Langenaeken et al.
5,348,375 A 9/1994 Steininger
5,369,825 A 12/1994 Reesby
5,369,827 A 12/1994 Parke et al.
5,403,549 A 4/1995 McNeil et al.
5,426,795 A 6/1995 Harty
D361,438 S 8/1995 Spencer et al.
D365,224 S 12/1995 Pohlman
5,472,270 A 12/1995 Czarnecky et al.
5,496,105 A 3/1996 Czarnecky et al.
5,507,050 A 4/1996 Welner
D370,572 S 6/1996 Lin
5,528,782 A 6/1996 Pfeuffer et al.
5,538,215 A 7/1996 Hosey
5,564,662 A 10/1996 Lussi et al.
5,564,663 A 10/1996 Cook et al.
5,565,834 A 10/1996 Hanley et al.
5,568,209 A 10/1996 Priester et al.
5,568,817 A 10/1996 Harty
D378,961 S 4/1997 Nordstrom et al.
D379,409 S 5/1997 Schwaegerle et al.
5,628,078 A 5/1997 Pennington et al.
5,638,644 A 6/1997 Bastian
5,645,313 A 7/1997 Best et al.
5,655,238 A 8/1997 Stickley et al.
5,660,405 A 8/1997 Campbell
5,661,859 A 9/1997 Schaefer
5,678,267 A 10/1997 Kinder
5,680,957 A 10/1997 Liu
D386,634 S 11/1997 Daugs
5,689,999 A 11/1997 Wiley et al.
5,706,678 A 1/1998 Sasaki
5,754,997 A 5/1998 Lussi et al.
5,771,513 A 6/1998 Kirchgeorg et al.
5,781,943 A 7/1998 Moenning et al.
5,855,207 A 1/1999 Moenning et al.
5,860,899 A 1/1999 Rassman
D404,945 S 2/1999 Simpkins et al.
D408,537 S 4/1999 Stickley et al.
D408,538 S 4/1999 Simpkins et al.
D408,539 S 4/1999 Simpkins
5,913,773 A 6/1999 Cox
5,919,131 A 7/1999 Smoler et al.
5,924,960 A 7/1999 Cohen
5,926,876 A 7/1999 Haigh et al.
5,953,773 A 9/1999 Asada et al.
D417,098 S 11/1999 Teufel et al.
D417,571 S 12/1999 Teufel et al.
D418,225 S 12/1999 Simpkins et al.
D420,225 S 2/2000 Lamb et al.
6,023,800 A 2/2000 Stickley
6,038,718 A 3/2000 Pennington et al.
6,073,284 A 6/2000 Borders
D428,629 S 7/2000 Cohen
6,101,652 A 8/2000 Matern, Jr.
6,106,065 A 8/2000 Carroll
6,115,978 A 9/2000 Bastian et al.
6,131,214 A 10/2000 Moenning et al.
6,173,461 B1 1/2001 Alexander
6,202,230 B1 3/2001 Borders
6,209,463 B1 4/2001 Koharchik et al.
6,212,713 B1 4/2001 Kuck et al.
6,230,343 B1 5/2001 Buiskool et al.
6,237,172 B1 5/2001 Morgan, Sr.
6,240,579 B1 6/2001 Hanson et al.
6,256,812 B1 7/2001 Bartow et al.
6,264,006 B1 7/2001 Hanson et al.
6,276,012 B1 8/2001 Borders
6,289,537 B1 9/2001 Hopper et al.
6,295,671 B1 10/2001 Reesby et al.
6,345,193 B1 2/2002 Dutto et al.
6,351,678 B1 2/2002 Borders
6,353,949 B1 3/2002 Falbo
6,363,555 B1 4/2002 LaRose
6,374,133 B1 4/2002 Dutto et al.
6,382,725 B1 5/2002 Carroll
D458,780 S 6/2002 Siepmann et al.
6,397,414 B1 * 6/2002 Lloyd ..... 5/622
D461,899 S 8/2002 Siepmann et al.
D461,900 S 8/2002 Siepmann et al.
D462,189 S 9/2002 Brockway et al.
D462,445 S 9/2002 Barde et al.
D462,674 S 9/2002 Siepmann et al.
D463,861 S 10/2002 Siepmann et al.
6,505,364 B1 1/2003 Simmons et al.
D473,312 S 4/2003 Cook
6,546,577 B1 4/2003 Chinn
6,550,084 B1 4/2003 Siepmann et al.
6,568,008 B1 5/2003 Siepmann et al.
6,638,299 B1 10/2003 Cox
6,651,279 B1 11/2003 Muthuvelan
6,659,556 B1 12/2003 Pellerin
6,678,908 B1 1/2004 Borders et al.
6,681,423 B1 1/2004 Zachrisson
6,718,582 B1 * 4/2004 Tinsley ..... 5/640
6,739,006 B1 5/2004 Borders et al.
6,754,923 B1 6/2004 Borders et al.
6,769,145 B1 8/2004 Pfeuffer et al.
D496,462 S 9/2004 Walters et al.
6,802,564 B1 10/2004 Brockway et al.
6,832,398 B1 12/2004 Borders et al.
6,857,147 B1 2/2005 Somasundaram
6,886,199 B1 5/2005 Schwaegerle
6,886,200 B1 5/2005 Blyshak et al.
2001/0000363 A1 4/2001 Borders
2001/0003789 A1 6/2001 Dutto et al.
2002/0000008 A1 1/2002 Borders
2002/0170115 A1 11/2002 Borders et al.
2002/0170116 A1 11/2002 Borders et al.
2003/0061662 A1 4/2003 Strobel et al.
2003/0071503 A1 4/2003 Brockway et al.
2003/0074735 A1 4/2003 Zachrisson
2003/0145383 A1 8/2003 Schwaegerle
2004/0068797 A1 4/2004 Smith et al.
2004/0074002 A1 4/2004 Bannister
2004/0074003 A1 4/2004 Bannister
2004/0098804 A1 5/2004 Varadharajulu et al.
2004/0133979 A1 7/2004 Newkirk et al.
2004/0172756 A1 9/2004 Somasundaram
2004/0172757 A1 9/2004 Somasundaram
2005/0015878 A1 1/2005 Bannister et al.

* cited by examiner

HEADREST LINKAGE

BACKGROUND OF THE INVENTION

The present invention relates generally to adjustable medical equipment and, more specifically, to an adjustable head support and support arm for an adjustable table.

During many examination procedures, the patient's head and neck may be repositioned if a different area of the neck or head is to be examined. If repositioning is necessary, the movement is preferably done with as little discomfort the patient as possible. Likewise, such repositioning should be performed easily by the medical examiner.

Generally, a headrest is coupled to an extended arm that is mounted or attached to an examination table or chair. The arm typically has two or three adjustable sections, and the headrest may also be adjustable. Locking devices, such as screws, bolts, or plunger elements, have been utilized to hold the arm sections in place. However, such devices generally are cumbersome and do not afford the headrest any resistance when removed or released from the locking section.

For instance, an examiner may wish to adjust a headrest while the headrest is still supporting a patient's head. In such instances, release of the prior art locking devices completely releases support for the patient and may possibly injure the patient. Likewise, an examiner's fingers are easily pinched within these moving parts. Though the devices may be easily manipulated, safety may be compromised to achieve such manipulation.

SUMMARY OF THE INVENTION

The present invention provides a linkage assembly comprised of adjustable linkage mechanisms for a headrest or other supported object. The assembly is comprised of rotatably movable arm sections connected in an end-to-end manner, with adjoining arm sections of the assembly pivoting around a supporting shaft. The arms are in a releasable interlocking relationship relative to one another. The rotatability of the adjoining arms is controlled by a handle attached to the shaft, which allows the user to interlock or disengage the adjoining arm sections and allows or prevents the arm sections from movement respective to one another. The design provides that each pivotable linkage mechanism of the assembly is independently controlled with respect to the other linkage mechanisms. Thus, adjustment of an individual linkage mechanism and corresponding arms is possible without needing to move the headrest section or other arm sections, and adjustment of the headrest section does not require movement of the arm sections.

The linkage mechanism comprises the supporting shaft that supports interacting elements that allow smooth adjustment of the mechanism. The shaft provides support for, among other elements, a friction disk, springs, and washers that provide pivotal movement and resistance for the arm sections to insure minimal injury or risk to the patient or examiner. The shaft also supports biasing means for disengaging the adjoining arms when the handle is in an open position. When the handle is moved to a closed position, the arms have meshing teeth that allow the arm sections to be held securely and firmly in place when the handle is in a closed or locked position. Though the teeth are free from each other when the handle is in an open position, the linkage mechanism is designed in such a fashion that the arms will retain their positions unless an outside force is provided on the arm.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
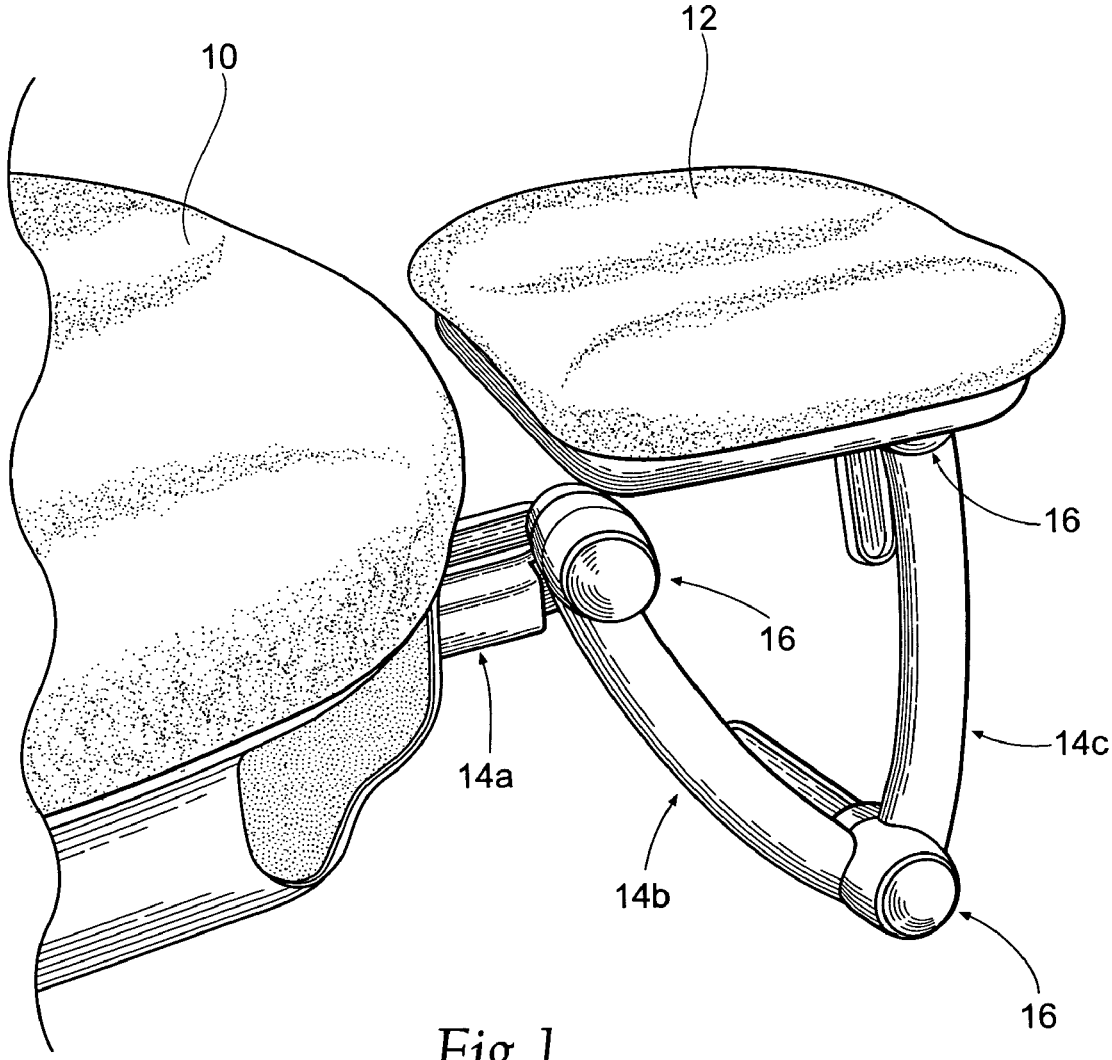
FIG. 1 shows a sectional perspective view of the present invention attached to an adjustable headrest on an examination table.

FIG. 1 shows a perspective sectional view of an examination table 10. The examination table 10 comprises a headrest 12, which is connected to the examination table 10 by a series of rotatably adjoined arms 14*a*, 14*b*, and 14*c*. The present invention comprises a linkage mechanism 16 that allows the arms 14*a*–14*c* to be rotatably connected to one another and also to the examination table 10 and the headrest 12. The linkage mechanisms 16 allow the headrest 12 to be secured in a wide array of angles and positions relative to the examination table 10. It should be noted that the arms 14*a*–14*c* may be referred periodically throughout the specification as the arms 14. This is for clarification purposes in showing that the linkage mechanism 16 may be used between any two adjoining sections.

Figure 2:
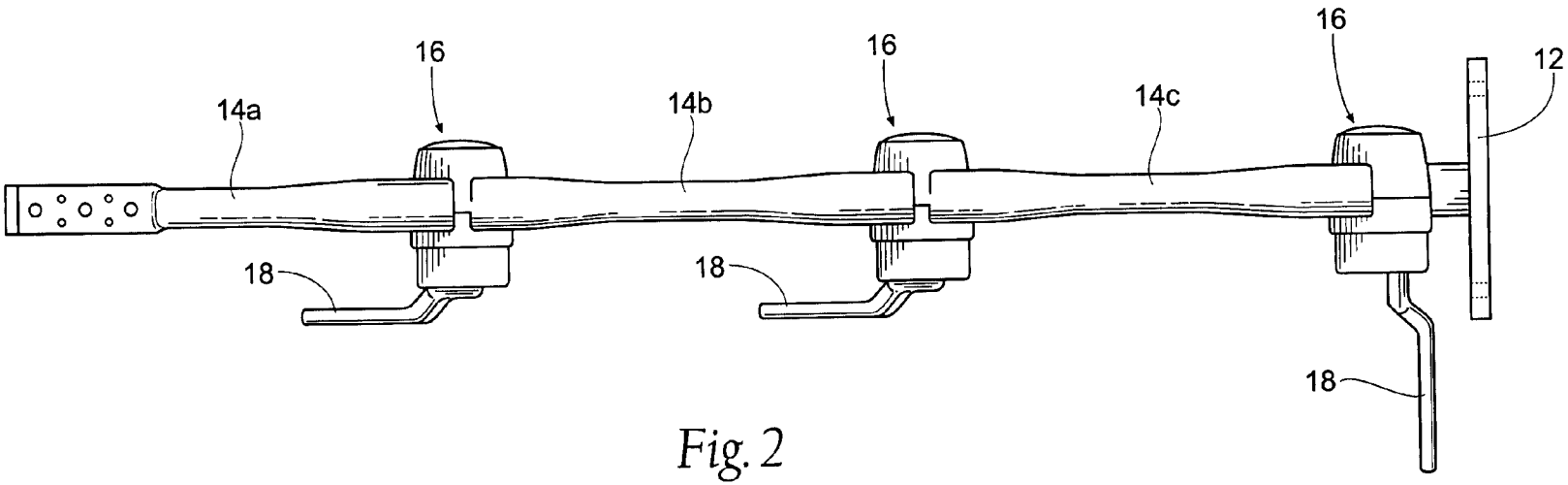
FIG. 2 is an overhead view of an adjustable arm utilizing the present invention.

Referring to FIG. 2, the assembled arms 14*a*–14*c* and linkage mechanisms 16 are shown from an overhead view. Each of the linkage mechanisms 16 has a handle 18 that allows each set of connected arms 14 to be individually locked in place. As shown in FIG. 2, the handle 18 located at the end of the arm 14*c* that is distal to the arm 14*b* is shown in an open position, while the two other handles 18 in FIG. 2 are shown in a closed position. Thus, only the linkage mechanism 16 associated with open handle 18 will rotate, which allows for easier and safer adjustment of the arms 14 over prior art assemblies. Again referring to FIG. 2, the arms 14 and the linkage mechanisms 16 are designed so that they are preferably axially aligned. That is, the arms 14*a*, 14*b*, and 14*c* are all aligned lengthwise from one another so that the arms 14 will be centered from the examination table 10 to the headrest 12. However, it is not necessary for the sections to be aligned in such a fashion to practice the present invention.

Figure 3:
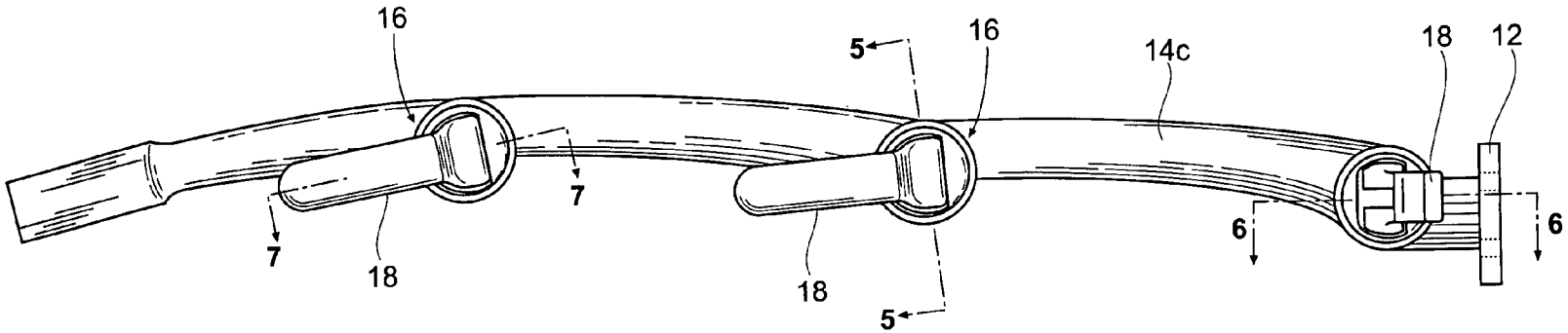
FIG. 3 is a side view of the arm shown in FIG. 2.

FIG. 3 shows the arms 14 and the linkages 16 from a side view. The handles 18 are designed in such a manner so that they do not interfere with a patient's neck or back when in either the open or closed positions. For instance, the handle 18 in the open position, as previously noted above with respect to FIG. 2, will not interfere with a patient (not shown) if the patient was resting on the headrest 12. The handles 18, when in a closed position, lie relatively along the elongated axis of the arms 14 so as to further ensure the handles 18 will not interfere with a supported patient. Preferably, the handles 18 are approximately 12° off center of the central axis of the arms 14, but any relative positioning of the handles 18 with respect to the arms 14 will fall within the scope of the invention.

Figure 4:
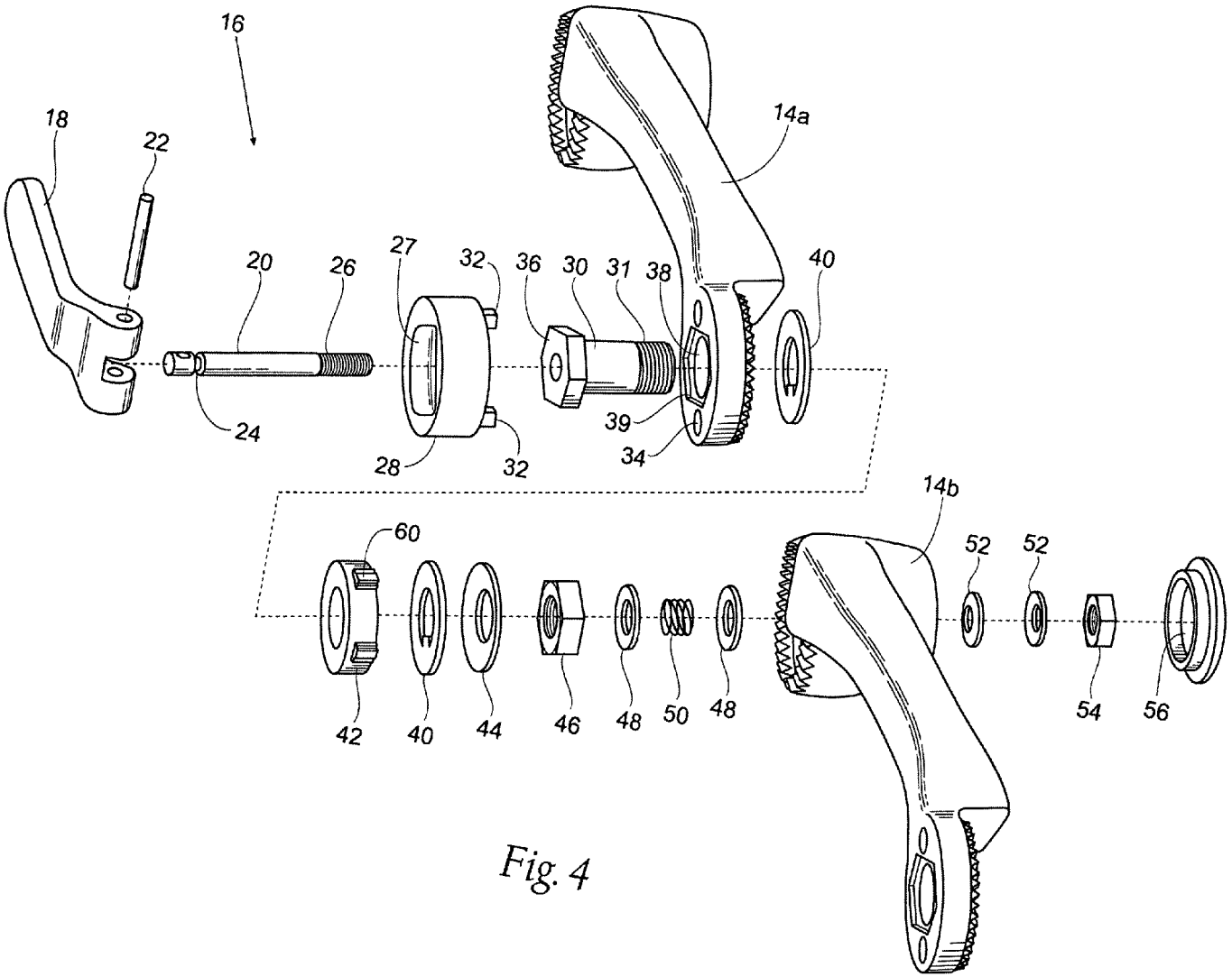
FIG. 4 is an exploded perspective view of the present invention.

FIG. 4 is an exploded perspective view of the linkage mechanism 16. The handle 18 is pivotably connected to a shaft 20 by a pin 22 that slides through aligned holes in the handle 18 and the shaft 20. A notch 24 is located on the shaft 20 to prevent the shaft 20 from interfering with the pivotal movement of the handle 18. The notch 24 provides the needed clearance area for pivoting of the handle 18 when the handle 18 is in a fully open position (see, in FIGS. 2 and 3, the position of the handle 18 between the arm 14*c* and the headrest 12). The shaft 20 further has a threaded portion 26 for securing a fastener onto the shaft 20, thereby holding the linkage mechanism 16 components in place, and forming the main support for the linkage mechanism 16.

The shaft 20 slides through an opening 27 located in the center of a pivot cap 28. The pivot cap 28 provides an area for the handle 18 to pivot against when closing the linkage mechanism 16. When the handle 18 is in a closed position, the pressure of the handle 18 pressing against the pivot cap 28 will cause the linkage mechanism 16 to compress and consequently lock the linkage mechanism 16 in place. The shaft 20 then slides through a threaded collar 30 having a threaded portion 31, and the arm 14*a*. To make sure the handle 18 and the shaft 20 do not unnecessarily rotate, the pivot cap 28 has a plurality of tabs 32 that mate with an equal number of holes 34 located in the arm 14. Likewise, a head 36 located on the threaded collar 30 is designed to be of the same shape as a polygonal section 39 of an aperture 38 located on the arm 14*a*, thus allowing the collar 30 and the arm 14*a* to be matingly secured. While the head 36 and the polygonal section 38 are shown to be hexagonal in shape, any shape or arrangement that allows the collar 30 and the arm 14*a* to be fittingly secured with one another is acceptable.

Still referring to FIG. 4, the shaft 20 and the collar 30 slide through the aperture 38 and through a washer 40, a friction disc 42 and another washer 40. The friction disc 42 provides resistance so that the arms 14*a* and 14*b* may still retain their positions with respect to one another even if the handle 18 is in an open position and the arms 14*a* and 14*b* are not locked together. The friction disc 42 is made of a solid material, such as a solid nylon material. More or fewer of the washers 40 may be used. Once the shaft 20 and the collar 30 pass the disc 42 and the washers 40, they will slide through a spring washer 44 and a locking nut 46. The inside of the locking nut 46 is threaded and mates with the threaded portion 31 of the collar 30. The spring washer 44 and the locking nut 46 allow for adjustment of the friction disc 42 resistance. The resistance of the friction disc 42 will increase proportionally with how far the locking nut 46 is threaded onto the collar 30.

After passing through the locking nut 46, the shaft 20 continues through a hardened washer 48, a spring 50 and one or more hardened washers 48. The shaft passes through the arm 14*b*, a pair of spring washers 52 and an end nut 54. The spring 50 and the spring washers 52 provide biasing means for the linkage assembly 16. When the handle 18 is in an open position, the spring 50 and the washers 52 bias the arms 14*a* and 14*b* away from one another so that the arms 14*a* and 14*b* may be adjusted. The end nut 54 is threaded onto the threaded portion 26 of the shaft 20 and allows the possible torque applied by the handle 18 to be increased or decreased. The number of hardened washers 48 and the number of spring washers 52 may be increased or decreased depending on the specifications of the user and, also, the actual dimensions of the linkage mechanism 16. An end cap 56 is fitted to the end of the second arm 14 to hide the end nut 54.

Figure 5:
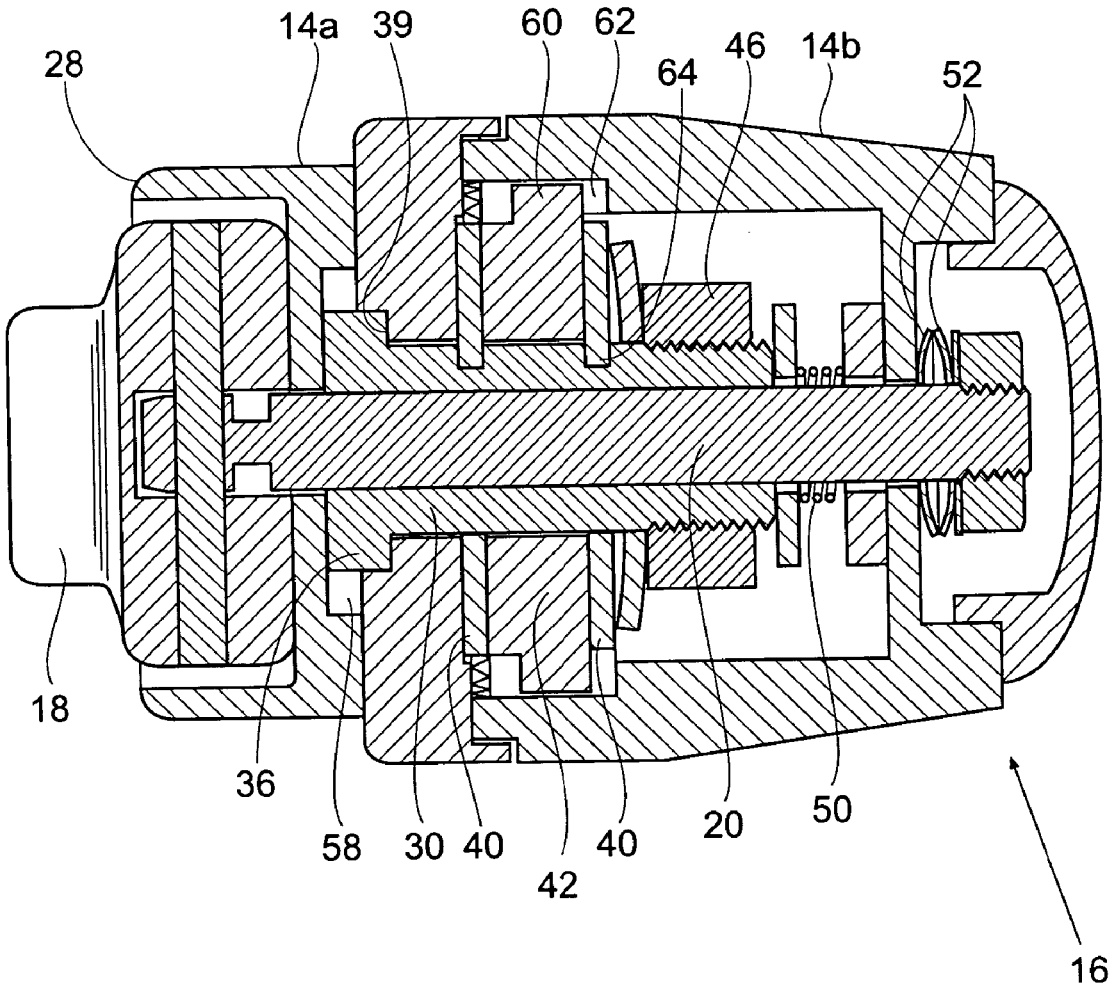
FIG. 5 a cross-sectional view of the present invention.

FIG. 5 shows a cross-sectional view of the linkage mechanism 16 described in FIG. 4 taken along line 5—5 of FIG. 3. The linkage mechanism 16 and the handle 18 are in a closed or compressed position. The arms 14*a* and 14*b* are meshed, preventing the linkage mechanism 16 from pivoting or rotating. The handle 18 sits within the pivot cap 28, which provides resistance for the handle to pivot against. The cap 28 also has a cutout area 58 that will partially house the head 36 of the threaded collar 30. The cutout area 58, while not necessary, allows for a shallower polygonal section 39, which necessitates less tooling when manufacturing the arms 14.

The cross-sectional view of FIG. 5 shows the interaction of the friction disc 42 and accompanying washers 40 with the linkage mechanism 16, and specifically with the arm 14*a*. The friction disc 42 has a plurality of protrusions 60 (see FIG. 4) that fit within mating slits 62 located in the arm 14*b*. The protrusions 60 prevent the disc 42 from rotating when the shaft 20 and the collar 30 are rotated. The washers 40 are keyed to fit into a slot 64 located on the collar 30, thereby preventing the washers from rotating if the friction disc 42 rotates with the arm 14*b*. As previously noted, the locking nut 46 provides and controls the resistance of the friction disc 42. The linkage mechanism 16 is preferably designed so that the friction disc 42 always gives at least some resistance.

Figure 6:
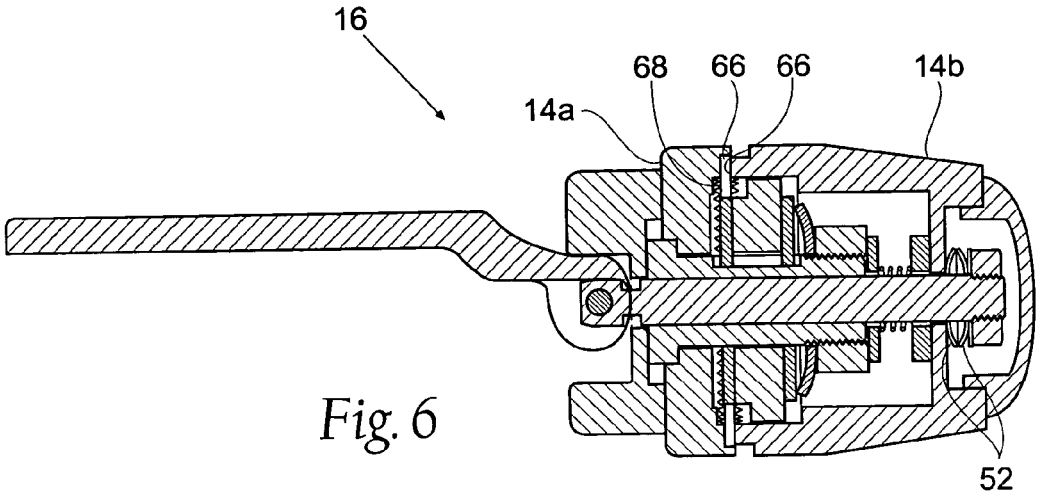
FIG. 6 is a cross-sectional view of the present invention in an unlocked position.

FIG. 6 shows a cross-sectional view of the linkage mechanism 16 in an open position taken along the line 6—6 of FIG. 3. The arms 14*a* and 14*b* each have an inner facing surface 66 that include a plurality of teeth 68. In an open position, the teeth 68 of the arm 14*a* are free from the teeth 68 of the arm 14*b* so that when an outside force is applied to the arms 14*a* and 14*b*, they are free to rotate.

Figure 7:
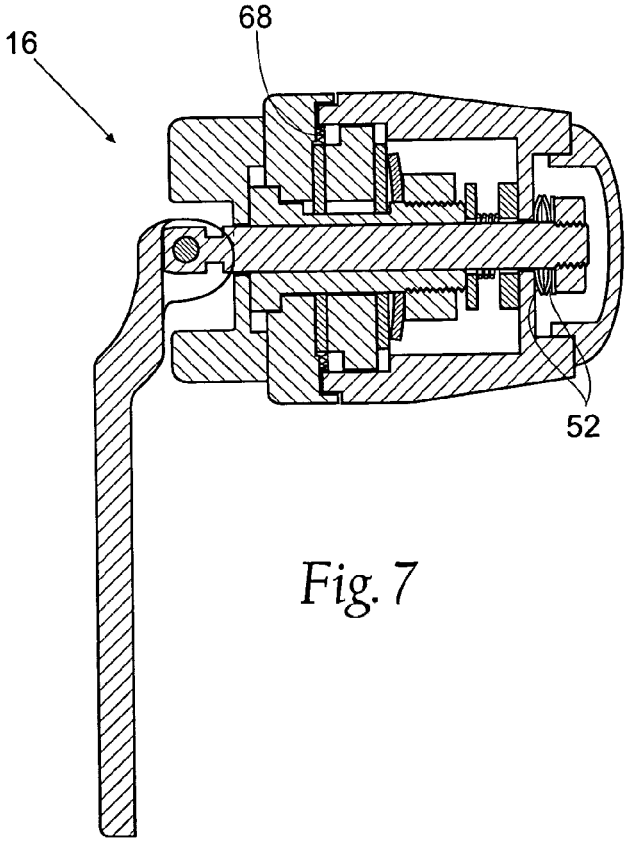
FIG. 7 is a cross-sectional view of the present invention in a locked position.

FIG. 7 shows a cross-sectional view of the linkage mechanism 16 in a closed position taken along line 7—7 of FIG. 3. The teeth 68 of the arms 14*a* and 14*b* are now meshed together, preventing either arm 14*a* or 14*b* to move relative to the other arm 14*b* or 14*a*, even if an outside force is applied to the arms 14*a* and 14*b*. Other locking mechanisms may be employed to lock the two arms 14*a* and 14*b* together. However, the meshing teeth 68 are preferred, as they solidly secure the arms 14*a* and 14*b* together, while allowing for multiple relative positions of the arms 14*a* and 14*b*. Similarly, the arms 14 may be manufactured from any solid material that will prevent the meshing teeth 68 from shearing if an outside is applied while the arms 14 are in a closed or locked position.

Figure 8:
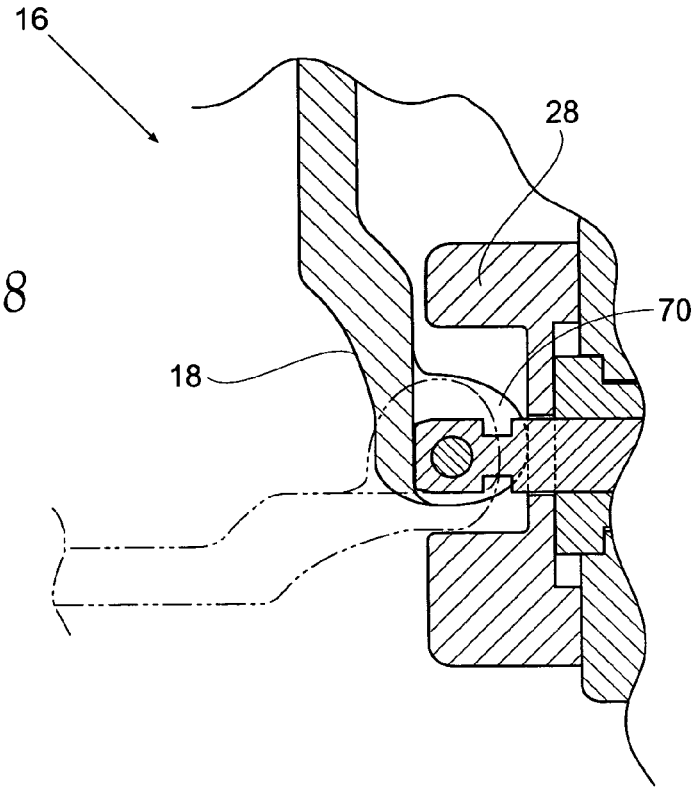
FIG. 8 is a sectional perspective view of the handle area of the present invention.

FIG. 8 shows the handle 18 in more detail. The handle 18 has an end 70 that is eccentric, which allows for over center movement of the handle 18. When the handle 18 is moved outward to an open position (shown in phantom), the end 70 will not be resting on the pivot cap 28, thereby releasing tension from the linkage mechanism 16 (see FIG. 6). When the handle 18 is moved inward to a closed position, the end 70 pushes down on the pivot cap 28, which compresses the linkage mechanism 16 (see FIG. 7). As shown in FIG. 7, the teeth 68 are forced into the mating position and lock the arms 14*a* and 14*b* securely into place. The eccentric shape of the end 70 allows the pivot cap 28 to be firmly compressed until the handle 18 is released to an open position.

An indentation 72 on the handle 18 allows the handle to sit in the closed position without interfering with the shaft 20 (see FIGS. 4 and 5).

The handle 18 is preferably designed so that it will be pivotally connected to the shaft 20 and the linkage mechanism 16. However, any handle design that will force the linkage mechanism 16 to compress the arms 14*a* and 14*b*. For instance the handle 18 may be designed as a clamp, a solenoid, a suction seal, or any other means of providing a force to compress the arms 14.

Figure 9:
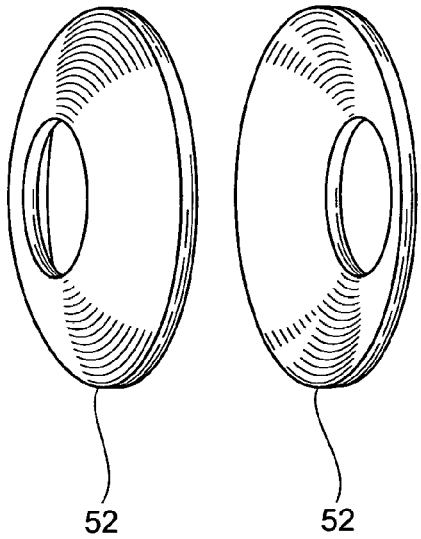
FIG. 9 is a perspective view of the biasing means of the present invention.

FIG. 9 shows the spring washers 52 in detail. The washers 52, preferably Belleville washers, sit next to each other in an opposing fashion, as shown in FIGS. 5, 6, and 7. The concave sides of the washers 52 face each other. Such an arrangement increases the compression ability of the linkage mechanism 16, which allows use of a smaller spring 50 (see FIG. 5). When the washers 52 are compressed, they are less than the height of the teeth 68 located on the arms 14, thereby preventing the teeth 68 from ratcheting. To insure the washers 52 perform properly, they should not be compressed more than about 90% from their original shape.

As previously mentioned, the arms 14 are not of any necessary configuration. For instance in FIG. 1 the headrest 12 is connected to the arm 14*c* by the linkage mechanism. It should be understood that in this instance the headrest 12 would fall within the scope of an arm 14, since the linkage mechanism 16 between the arm 14*c* and the headrest 12 works in the same manner as described between two separate arms 14.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. An adjustable linkage mechanism for pivotable support of an object, said linkage comprising:

a supporting pivot shaft;

a pair of arms rotatably mounted on said supporting pivot shaft, said arms being in a releasable interlocking relationship relative to one another;

a handle connected to said shaft, said handle providing means for allowing interlocking engagement of said arms; and friction retention means for resisting rotational movement of said arms, said friction retention means allowing said arms to retain said position of said interlocking relationship while said arms are in an axially disengaged relationship.

2. The linkage mechanism according to claim 1 wherein each of said arms further comprises an inwardly facing surface positioned for fixed rotational engagement with one another.

3. The linkage mechanism according to claim 2 further comprising means for adjusting retention ability of said friction retention means.

4. The linkage mechanism according to claim 3 wherein said retention adjusting means further comprises a threaded locking nut and an externally threaded collar, said collar comprising:

a head, said head bearing against an oppositely disposed surface of said inwardly facing surface of one of said arms;

a through bore for slidably receiving said shaft; and an externally threaded portion, said threaded portion securing said locking nut to said collar.

5. The linkage mechanism according to claim 4 wherein said friction retention means rests between said locking nut and said one of said arms.

6. The linkage mechanism according to claim 2 wherein said inwardly facing surfaces of said arms further comprise meshing teeth.

7. The linkage mechanism according to claim 1 further comprising means for adjusting said interlocking engagement means of said handle.

8. The linkage mechanism according to claim 1 further comprising biasing means for axially disengaging said interlocking arms.

9. The linkage mechanism according to claim 8 wherein said biasing means comprises a helically wound compression spring circumjacently mounted on said shaft.

10. The linkage mechanism according to claim 8 wherein said biasing means comprises a Bellville washer circumjacently mounted on said shaft.

11. The linkage mechanism according to claim 10 wherein said biasing means further comprises a helically wound compression spring circumjacently mounted on said shaft.

12. The linkage mechanism according to claim 11 wherein said biasing means further comprises a second Bellville washer, said second Bellville washer oppositely disposed to said first Bellville washer.

13. The linkage mechanism according to claim 1 wherein said pair of arms are coaxially mounted on said shaft.

14. The linkage mechanism according to claim 1 wherein said handle is pivotally connected to said shaft.

15. The linkage mechanism according to claim 1 wherein said supported object comprises a headrest.

16. An adjustable linkage assembly for pivotable support of an object, said linkage assembly comprising:

a plurality of arms connected end to end in a releasable interlocking relationship; and a plurality of linkage mechanisms for pivotably connecting said arms, each of said linkage mechanisms further comprising a handle for moving said arms from an interlocking position to a disengaged position and friction retention means for allowing said arms to retain a relative position to one another, said friction retention means allowing said arms to retain said position of said interlocking relationship while in said disengaged position, each of said linkage mechanisms independently adjusted by said respective handle.

17. The adjustable linkage assembly according to claim 16 further comprising means to adjust said friction retention means.

18. The adjustable linkage assembly according to claim 16 wherein each of said arms further comprises an inwardly facing surface positioned for rotational engagement with one another.

19. The adjustable linkage assembly according to claim 18 wherein said inwardly facing surfaces of said arms further comprise meshing teeth.

20. The adjustable linkage assembly according to claim 16 further comprising biasing means for axially disengaging said arms.

21. The adjustable linkage assembly according to claim 16 wherein said arms are coaxially connected with respect to one another.

22. The linkage assembly according to claim 16 wherein said supported object is a headrest.

* * * * *